United States Patent [19]

Droske

[11] 3,969,915

[45] July 20, 1976

[54] LOCK

[75] Inventor: Klaus Droske, Gifhorn, Germany

[73] Assignee: Volkswagenwerk Aktiengesellschaft, Wolfsburg, Germany

[22] Filed: Aug. 23, 1974

[21] Appl. No.: 500,193

[30] Foreign Application Priority Data

Sept. 29, 1973 Germany ..... 2349182

[52] U.S. Cl. ..... 70/364 R; 70/377; 70/409

[51] Int. Cl.[2] ..... E05B 15/14; E05B 19/06; E05B 29/06

[58] Field of Search ..... 70/364 R, 377, 409

[56] References Cited

UNITED STATES PATENTS

| | | | |
|---|---|---|---|
| 1,298,224 | 3/1919 | King | 70/364 R |
| 1,644,365 | 10/1927 | Bennett | 70/364 R |
| 2,023,207 | 12/1935 | Olson | 70/364 R |
| 2,030,836 | 2/1936 | Full et al. | 70/364 R X |
| 2,035,181 | 3/1936 | Molinare | 70/364 R X |
| 2,729,091 | 1/1956 | Taylor | 70/364 R X |
| 3,707,863 | 1/1973 | Schwab et al. | 70/364 R |

FOREIGN PATENTS OR APPLICATIONS

| | | | |
|---|---|---|---|
| 28,286 | 12/1909 | United Kingdom | 70/364 R |
| 702,773 | 3/1966 | Italy | 70/377 |

*Primary Examiner*—Paul R. Gilliam
*Assistant Examiner*—Carl F. Pietruszka
*Attorney, Agent, or Firm*—Spencer & Kaye

[57] ABSTRACT

A cylinder lock having a non-rotatable part which is provided with an axially extending chamber and one or more recesses communicating with the chamber. A plug is arranged in this chamber for rotation about an axis, and a key is axially insertable into the plug. A number of tumblers are slidably mounted on the plug for movement transverse to the axis into and out of the recesses, the purpose of these tumblers being to prevent rotation of the plug when at least one of the tumblers extends into a recess. Each tumbler has an opening through which the key, when inserted into the plug, may extend. The tumblers are spring-biased for movement into positions where the tumblers are in a recess. The openings of the tumblers have respective contours that provide two contact edges which are next to each other and which are stepped in the transverse direction of movement of the tumblers, and the key has a number of parallel, axially extending longitudinal edges each of which engages a contact edge of at least one of the tumblers for pressing the respective tumbler, against the action of its associated spring, out of the recess.

4 Claims, 7 Drawing Figures

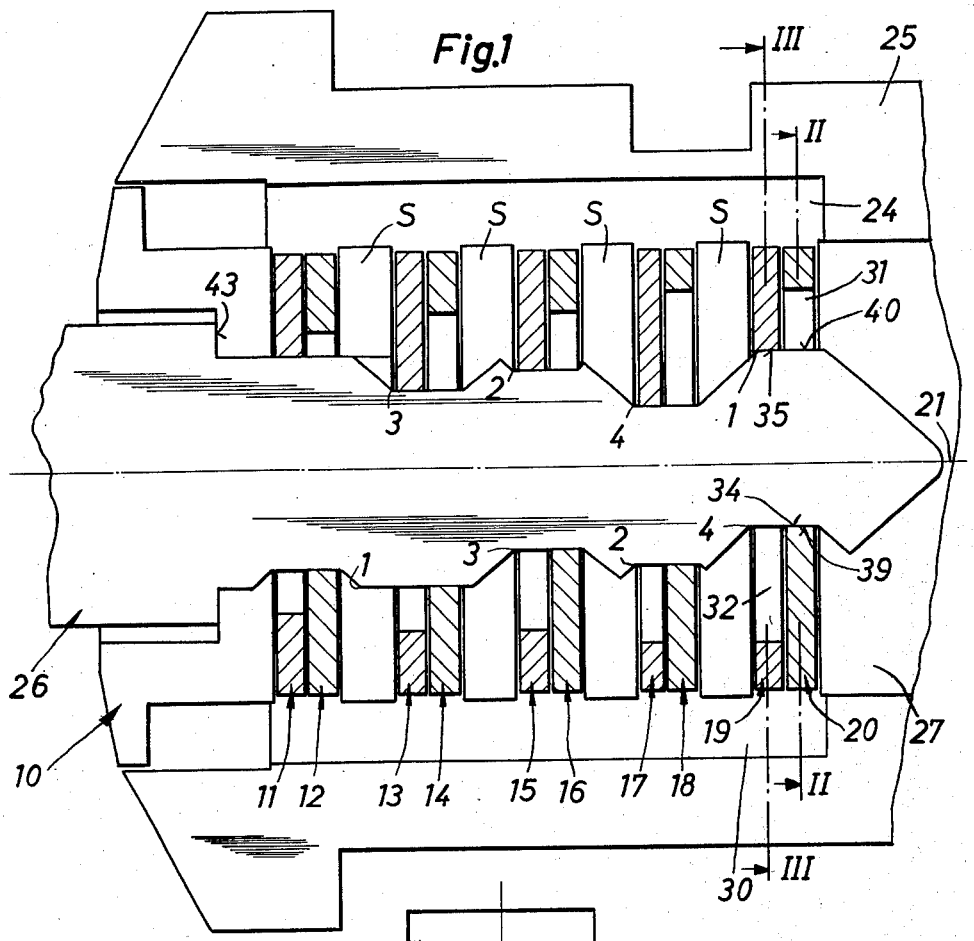
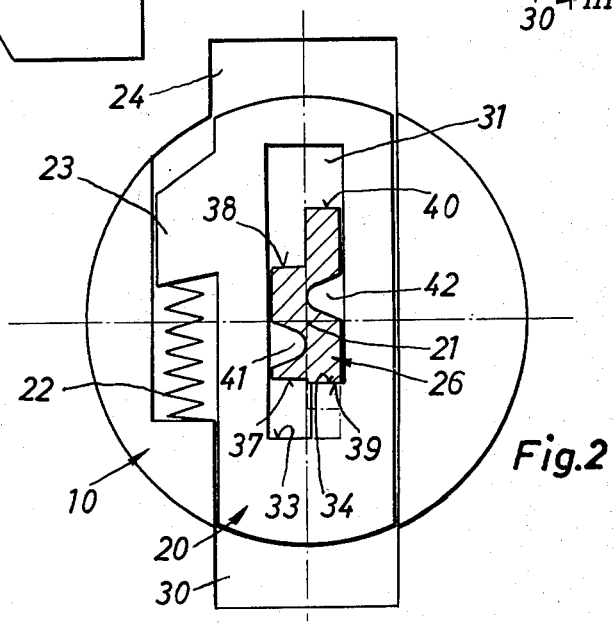
Fig.2

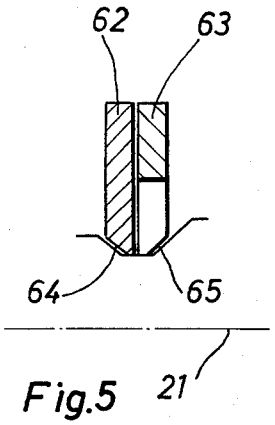
Fig.5
Fig.3
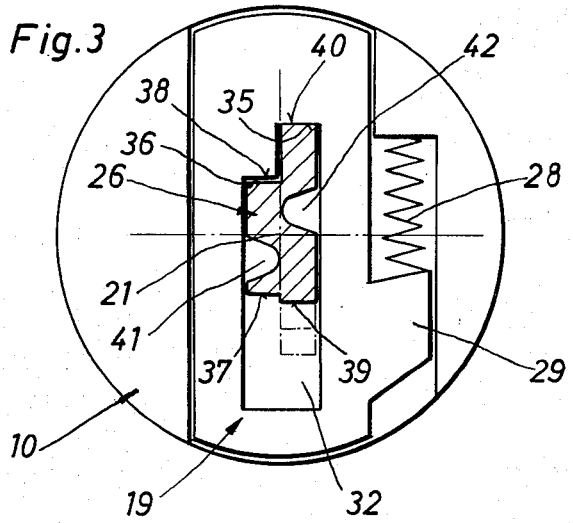
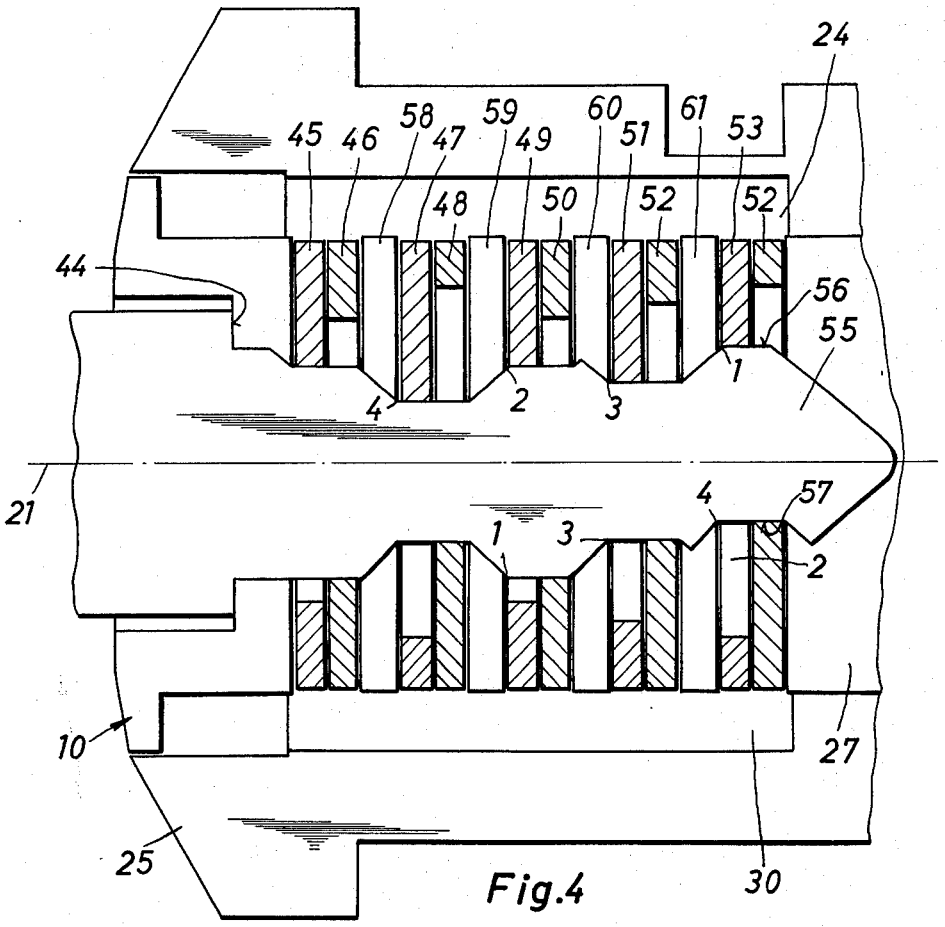
Fig.4

LOCK

BACKGROUND OF THE INVENTION

The present invention relates to a cylinder lock having a locking cylinder, known as a revolving plug, which is adapted to receive an axially insertable key. In cylinder locks of this type, the plug is provided with tumbler plates which themselves have recesses that form abutment edges which allow the key to be inserted. When a key is inserted into the plug, tumbler springs which coact with the tumbler plates cause the latter to engage a longitudinal edge of the key, the arrangement being such that only when the appropriate key has been inserted, will all of the tumbler plates be out of engagement with a recess that is provided in a stationary, non-rotatable part surrounding the plug. Thus, in conventional cylinder locks of this type, the proper key has to be inserted in order to move all of the tumbler plates out of the recess of the non-rotatable part, so that only then can the inserted key be used to turn the revolving plug.

For obvious reasons, it has been sought to build cylinder locks of the above type which are as simple and compact as possible and which at the same time provide as large a number of locking variations as possible. Thus the industry has sought to build locks of this type which, while using a minimum number of parts and as little space as possible, will provide a maximum number of locking combinations, any one of which allow the lock to be opened only with the use of the key specifically adapted to such locking combination.

It is therefore, an object of the present invention to provide a cylinder lock which is compact, which nonetheless is capable of providing a large number of locking combinations, and which can be mass-produced at low cost. Such a lock is suitable not only for general purposes, but is particularly well suited for use in the automotive field, especially as a door lock for motor vehicles. For such application, the key to the door lock must frequently serve as the ignition key as well. Moreover, the compactness is especially important in the automotive field, in view of the limited available space in which the lock must be accomodated, namely, in the space between the sheet constituting the outer panel of the door and the crank disc. In modern automotive design in particular, the available space is continually decreasing.

It is another object of the present invention to provide a cylinder lock of the above which can be used with a reversible key, i.e., a key which can be inserted into the lock in either one of two positions.

BRIEF DESCRIPTION OF THE PREFERRED EMBODIMENTS

With the above objects in view, the present invention resides in a cylinder lock having a non-rotatable part which has an axially extending chamber and recess means communicating with the chamber. A plug is arranged in this chamber for rotation about an axis, there being a key which is axially insertable into the plug. The lock has a plurality of tumblers which are slidably mounted on the plug for movement transverse to the axis into and out of the recess means, these tumblers preventing rotation of the plug when at least one of the tumblers extends into the recess means. Each tumbler has an opening through which the key, when inserted into the plug, may extend. Spring means are provided for the tumbler for continually biasing the same for movement into the recess means. The openings of the tumblers have respective contours that provide two contact edges which are next to each other and which are stepped in the transverse direction of movement of the tumblers. The key has a plurality of parallel, axially extending longitudinal edges each of which engages a contact edge of at least one of the tumblers for pressing the respective tumbler, against the action of the associated spring means, out of the recess means.

According to the embodiment of the present invention, the tumblers, which may be plate-shaped, are arranged in pairs, with the tumblers of each pair being identical and located next to each other but oriented to occupy positions which are angularly displaced with respect to each other by 180° about the axis. The spring means associated with the two tumblers of each pair urge the two tumblers in opposite directions. The longitudinal edges of the key are arranged at least approximately opposite each other and each longitudinal edge engages the contact edge of a respective one of the two tumblers of each pair. Each longitudinal edge of the key, and the respective contact edge of the respective tumbler engaged thereby, are spaced the same distance from the axis such that upon interengagement of the key and tumblers, the latter are maintained out of the recess means. Moreover, the distance which each longitudinal edge of the key, at the point along its length where such edge is in axial alignment with a given tumbler but is out of engagement with any contact surface thereof, is spaced from the axis is the same as the distance which the non-engaged contact edge of such tumbler is spaced from the axis, thereby allowing the key to be inserted into the lock in either of two positions, which are mutually displaced by 180° about the axis, and still enable the key to move the tumblers out of the recess means.

BRIEF DESCRIPTION OF THE DRAWINGS

FIG. 1 is a longitudinal sectional view of one embodiment of a cylinder lock according to the present invention.

FIG. 2 is a sectional view taken on line II—II of FIG. 1.

FIG. 3 is a sectional view taken on line III—III of FIG. 1.

FIG. 4 is a longitudinal sectional view of another embodiment of a cylinder lock according to the present invention.

FIG. 5 is a fragmentary, partly sectional view showing yet another embodiment of the present invention.

DETAILED DESCRIPTION OF THE PREFERRED EMBODIMENTS

Figure 6:
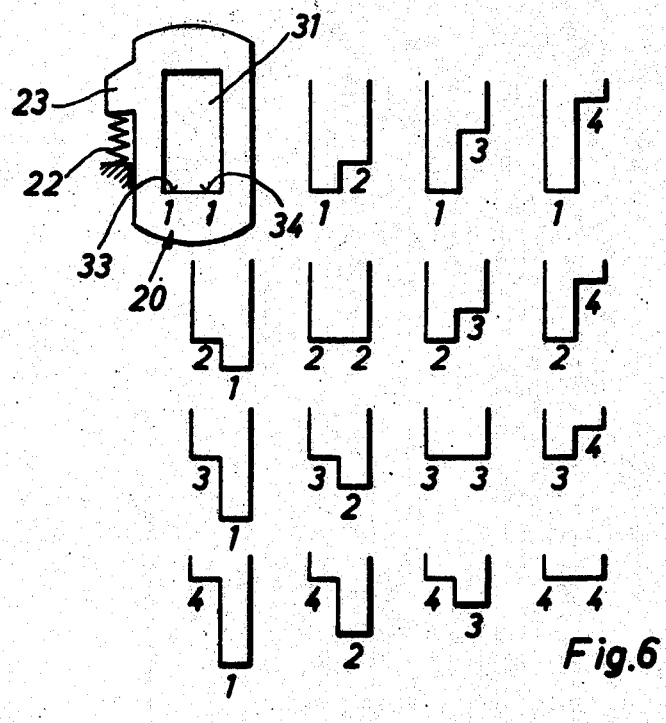
FIG. 6 is a diagrammatic illustration showing various types of tumbler configurations.

Referring now to the drawings and to FIGS. 1 to 3 thereof in particular, the same show a locking cylinder or revolving plug 10, which, in the illustrated embodiment, is provided with a total of ten slidable tumbler plates 11, 12, 13, 14, 15, 16, 17, 18, 19 and 20. The plates, hereinafter referred to simply as "tumblers", are arranged in five sets of two each, the sets being separated by spacers S, and the two tumblers of each pair are immediately adjacent to each other in axial direction and are of identical construction. However, the two tumblers of each pair of tumblers are angularly displaced from each other by 180° about the axis 21 of the lock. This can best be seen from a side-by-side comparison of FIGS. 2 and 3, which depict the positions of the tumblers 20 and 19, respectively. Thus, FIG. 2 shows the tumbler 20 with its projecting nose 23 extending leftwardly as viewed in FIG. 2, there being a compression spring 22 interposed between the nose 23 and a surface of the plug 10, so that the tumbler 20 is pressed upwardly, again as viewed in FIG. 2, into a recess 24 (see FIG. 1) constituted by a slot which extends through the non-rotatable part 25 which surrounds the plug 10. Here it should be noted that FIGS. 1 to 3 show the parts in the positions they occupy while the proper key 26 is in the lock, so that the tumbler 20 is shown as having been drawn out of the recess 24 against the action of the spring 22 which, but for the presence of the key, would hold the tumbler 20 in a position where it extends into the recess 24. Consequently, the tumbler 20 will not prevent the key from being turned, and the key, whose tip extends into the part 27, can therefore turn that part.

FIG. 3 shows that the tumbler 19 is identical to the tumbler 20, but that it occupies a position that is angularly displaced about the axis 21, by 180°, from the position of the tumbler 20. Thus, the projecting nose 29 of the tumbler 19 extends to the right, as viewed in FIG. 3, and the spring 28 which coacts with the nose 29 continually seeks to press the tumbler 19 downwardly, again as viewed in FIG. 3, into a further recess 30 (see FIG. 1) of the non-rotatable part 25. Of course, due to the presence of the key 26, the tumbler 19 is shown as occupying a position where its lower end does not extend into the recess 30.

It will be seen from FIGS. 2 and 3 that not only the outer contours of the tumblers 19 and 20 but also the contours of their respective internal cut-outs 32, 31, are alike. The key 26, when inserted into the lock, extends through the openings 31, 32, and the contours of these openings provide contact edges 33, 34 (tumbler 20) and 35, 36, (tumbler 19), which may be engaged by the longitudinal edges of the key 26. The latter has a total of four such longitudinal edges shown at 37, 38, 39 and 40. Of these, the edges 37 and 39 are at the bottom, as viewed in FIGS. 1 to 3, and edges 38 and 40 are at the top, with the edges 37 and 38 and the edges 39 and 40 being exactly opposite each other with respect to the axis 21. As shown in FIGS. 2 and 3, the contact edge 34 of tumbler 20 is in engagement with the edge 39 of the key 26 while the contact edge 35 of tumbler 19 is in contact with the edge 40 of the key, i.e., the tumblers 20 and 19 and in contact with the opposite edges 39 and 40 of the key.

FIGS. 2 and 3 also show that the key 26 is provided with two longitudinal grooves 41 and 42, which are staggered with respect to each other, and which receive suitably configured guide strips (not shown) with which the plug 10 is equipped. This facilitates the insertion and withdrawal of the key.

FIG. 1 illustrates one of the many possible configurations of the longitudinal edges 39 and 40 of the key. The web of the key is provided with indentations, each of which extends to one of four depths, shown by lines 1, 2, 3 and 4, which are spaced certain distances from the axis 21. These lines, hereinafter referred to as "levels", represent the positions of the various bottoms of the recesses, as well as the positions of the various contact edges of the various tumblers when the key is inserted, taken with respect to the axis 21.

Referring now, by way of example, to the tumbler 20, it will be appreciated that the level of the contact edge 34 is one of several criteria insofar as the selection of the proper key is concerned. Another criterion is the level of the contact edge 35 of tumbler 19. As can be seen from FIG. 1, the contact edges 34 and 35 are at levels 4 and 1, respectively.

While the foregoing would sufficiently characterize the tumblers 19 and 20 if the key were not a reversible one, the fact that the lock is intended for use with a reversible key makes it necessary for the contact edges 33 and 36 of tumblers 20 and 19, respectively to be at the appropriate levels. This is so because when the key 26 is inserted in a position which is angularly displaced by 180° from the position depicted in FIGS. 1 to 2, it will be the key edge 40 which will now occupy the lower left-hand position, as viewed in FIG. 2, and this edge 40 will then coact with the contact edge 33 of tumbler 20. Thus if the same key is to maintain the tumbler in the proper position, the contact edge 33 must likewise occupy level 1. Similarly, the tumbler 19 will have its contact edge 36 engaged by the edge 39 of the key, so that if this tumbler, too, is to occupy the proper position, the contact edge 36 must occupy level 4.

In short, when the key is inserted while oriented as shown in FIGS. 1 to 3, key edge 39 engages contact edge 34 of tumbler 20 and key edge 40 engages contact edge 35 of tumbler 19; when the key is inserted in the reversed position, i.e., a position angularly displaced by 180° about the axis 21 from the position depicted in FIGS. 1 to 3, key edge 40 engages contact edge 33 of tumbler 20 and key edge 39 engages contact edge 36 of tumbler 19. Key edge 39 and tumbler contact edges 34 and 36 are at level 4, whereas key edge 40 and tumbler contact edges 33 and 35 are at level 1.

It will be seen from the above that the levels of the two adjacent contact edges of each tumbler are important for the proper functioning of the lock. It will, moreover, be understood that if the tumblers are designed to have their contact edges at any one of four different levels, there are sixteen possible combinations so that any one tumbler can have one of sixteen configurations. This is shown in FIG. 6 which depicts, by way of example, the tumbler 20 having its nose 23 at the upper left, with the spring 22 being interposed between the nose and a surface of the plug (not shown in FIG. 6). In the illustration at the upper left-hand corner, the contact edges 33 and 34 of the opening 31 are both at the level 1. Proceeding from left to right in the first line of illustrations, the contact surfaces are at levels 1 and 2, respectively; at levels 1 and 3, respectively; and at levels 1 and 4, respectively (the latter being the arrangement depicted in FIG. 2). The illustrations in the next three lines show the other possible levels. It will be noted that in four of the illustrations the levels of the adjacent contact edges are the same; in the other twelve illustrations, the contact edges are at different levels to provide a stepped configuration.

The above affords a convenient nomenclature for the tumblers, such as type 1, 1 for the top-left configuration, type 1, 2 for the next tumbler, and so on, with the last tumbler configuration, depicted at the right-hand end of the last line being type 4, 4. The tumbler 20, and of course the tumbler 19 which must be visualized in a position turned angularly 180° about the axis 21 from the position depicted in FIG. 3, are each type 1,4.

As is apparent from FIG. 1, the tumblers of each pair of tumblers are of the same type, i.e. tumblers 11 and 12 will be of the same type, tumblers 13 and 14 will be of the same type, and so on, and each pair of tumblers will be of a type which matches the configuration of the particular key which is to be used with the respective lock. That is to say, each pair of tumblers will conform to that portion of the length of the key which, when the key is in the lock, is in axial alignment with the respective tumbler pair. Thus, in the embodiment depicted in FIG. 1, tumblers 11 and 12 are type 1, 2; tumblers 13 and 14 are type 3, 1; tumblers 15 and 16 are type 2, 3; tumbler 17 and 18 are type 4, 2; and, as already mentioned, tumblers 19 and 20 are type 1, 4.

The fact that each pair of tumblers is made up of two identical tumblers does not, however, limit the number of possible combinations, because as will be seen from FIGS. 2 and 3, the levels along the length of each of the longitudinal edges 39 and 40 of key 26 can be arbitrarily selected even in the regions where the other longitudinal edge engages a tumbler pair, i.e. in matching any one key to any one lock, the levels of the key and contact edges can be selected at will. Inasmuch as the tumblers of each pair, here the tumblers 19 and 20, are identical, the contact edge of one of the tumblers, e.g., contact edge 33 of tumbler 20, will be at the same level as the diammetrically opposite contact edge of the other tumblers; in this case, contact edge 35 of tumbler 19. However, it will be seen that the diammetrically opposed contact edges of the two tumblers of any one pair will not be "working" at the same time, rather, it will be the contact edges which are directly opposite each other, that is to say, the contact edges 34 and 35 of tumblers 20 and 19, respectively, which are opposite each other. For each key edge which, in any one position of the key, coacts with one of the two tumblers, e.g., key edge 39, the other tumbler of the pair, here the tumbler 19, will provide sufficient play through its opening 32 so that the key edge will not be in physical contact with any edge of the opening 32.

The remaining longitudinal edges 37 and 38 of the key 26, which as shown in FIG. 2, are somewhat beveled, may be used for purposes of guiding the key in the lock.

The above notwithstanding, it may be that the number of different possible combinations will be limited to a certain extent. This is so because the bevel angle may impose a limit to the depth to which the key 26 may be cut in the vicinity of the right-angle abutment 43 (see FIG. 1). Thus, the key may, in the vicinity where it coacts with the first pair of tumblers, be cut only as far as level 3. Other than that, the level between consecutive tumbler engaging portions of the key may jump as much as the full three levels, see, for example, the change from level 4 to level 1 going from tumbler 17 to tumbler 19.

Referring now to FIG. 4, the same illustrates another embodiment of the invention, which differs from the embodiment illustrated in FIG. 1, in that it is axially shorter and thus suitable for use where less space is available. On the other hand, the compactness of this embodiment allows the first tumbler engaging portion, i.e., the one next to right-angle abutment 44 of the key 55, to be cut no lower than level 3, and the maximum level change from tumbler pair to tumbler pair is two, thus reducing the total number of possible combinations.

Structurally, the lock of FIG. 4 is similar to the lock of FIG. 1, there being five tumbler pairs identified at 45, 46; 47, 48; 49, 50; 51, 52; and 53, 54, coacting with the two of the four longitudinal edges of key 55, namely, the edges 56 and 57. The tumbler pairs, going from left to right, are of the type 2, 1; 4, 3; 2, 1; 3, 3; and 1, 4. The tumbler pairs are separated by spacers 58, 59, 60 and 61, the key having its beveled portions at those points along its axial length which, when the key is in the lock, are in alignment with the spacers. In this embodiment, as in the embodiment of FIG. 1, the same plug 10 can be used irrespective of the tumbler types used in the lock.

FIG. 5 fragmentarily illustrates another modification which makes it possible for the lock to be even more compact. This is achieved by letting some or, if desired, all of the tumblers extend axially beyond those stretches of the longitudinal edges of the key which are parallel to the axis 21. Thus, FIG. 5 shows tumblers 62 and 63 having beveled edges which, when the key is in the lock, are in axial alignment with beveled portions 64 and 65 of the key. This allows the overall axial length of the lock to be reduced without sacrificing the number of possible combinations.

Figure 7:
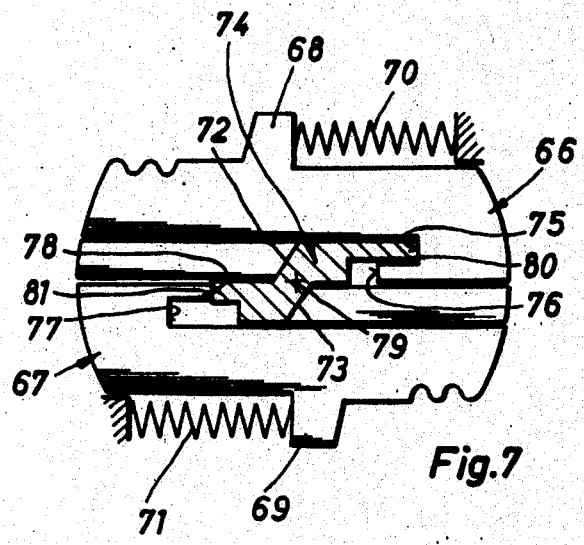
FIG. 7 is a fragmentary, partly sectional view showing a detail of still another embodiment of the present invention.

FIG. 7 shows still another modified embodiment of the present invention which differs from the above described embodiments in that the two tumblers of each pair are not axially adjacent but are coplanar and lie next to each other in a direction transverse to the axis of the lock, each tumbler being, in effect, what may be considered to be a half-plate. Thus, FIG. 7 shows two tumblers 66 and 67 having respective noses 68 and 69 coacting with respective springs 70 and 71 which bias the tumblers in opposite directions for movement into recesses provided in the non-rotatable part of the lock which surrounds the plug. These recesses are not shown in FIG. 7, but correspond to the recesses 24 and 30 in the part 25 described in connection with the embodiment of FIG. 1. The tumblers are provided with respective openings 72 and 73. The contour of these openings are not closed but are open on one side, the open sides of the two openings being directed toward each other, and the key 74 extends through the composite opening formed by the individual openings 72, 73. As in the previously described embodiments, the contour of each opening is such as to form two contact edges, those of tumbler 66 being shown at 75 and 76 and those of tumbler 67 being shown at 77 and 78. If, for example, edge 75 is at level 1 and edge 76 at level 3, edges 77 and 78 will be at levels 1 and 3, respectively, the tumblers 66 and 67 being identical, though of course angularly displaced by 180° about the axis 79 of the lock. As shown in FIG. 7, the opposite stepped contact edges are laterally slightly offset with respect to the direction of transverse movement of the tumblers.

The key 74 has two working longitudinal edges 80 and 81 which are approximately opposite each other, there likewise being a slight lateral offset, with respect to the axis 79. Each of the longitudinal edges of the key engages a respective one of the two tumblers 66 and 67; if the key reversed and introduced into the lock, the longitudinal edge 80 will contact edge 77 of tumbler 67 and edge 81 will engage edge 76 of tumbler 66.

It will thus be seen that, in accordance with the present invention, the same key can be used in either one of two positions, i.e., the key can be introduced in such a way that, depending on the particular way in which it is inserted, the appropriate longitudinal edges of the key will always assume the correct lateral position with respect to the axis of the lock. In this way, two effective longitudinal edges on the key will, depending on how the key is inserted, always coact with the appropriate two pairs of contact edges of the tumblers.

It will be seen from the foregoing that the present invention provides a number of advantages over heretofore conventional cylinder locks. Consider, for example, a conventional cylinder lock having ten tumblers, of which six are combined into three pairs of two each. If the key has a web which can be notched to any one of four depths, corresponding to the four levels referred to above, there will be obtained a lock having a theoretical maximum of $4^7 = 16{,}384$ locking combinations. This number can be increased by varying the locations at which the tumblers are built into the lock. For example, in form, the tumbler pairs can be at the first, third and fifth positions where the key engages the tumblers, while in another form of the lock, the pairs can be at the second, fifth and sixth positions. In each case, the remaining positions are occupied by single tumblers. Thus, there are thirty-five ways of arranging the three tumbler pairs at the seven different positions, and this increases the maximum number of variations to approximately 59,500. However, this increase carries with it increased manufacturing costs, because each of the 35 ways of arranging the tumbler pairs requires a different plug. This requires the manufacture of a large series of locks resulting in increased stock piling, as well as different tools, so that in practice there will be a considerably smaller number of combinations available, which, in turn, reduces the security of any one lock. The present invention, on the other hand, avoids these drawbacks in that it utilizes transversely movable tumblers which have the mentioned stepped contact edges. That is to say, the present invention makes use of a second dimension to increase the maximum possible number of locking combinations. In the embodiment of FIG. 1, for example, which uses five pairs of tumblers and a key capable of being notched to any one of four levels, the provision of two steps on each tumbler allows $16^5 = 1{,}048{,}576$ combinations. This, however, is not the sole advantage of the present invention over the prior art, because each of the combinations can be obtained while using the same basic locking cylinder construction; this is so because any one of the five positions along the length of the axis 21 can be used to accommodate a tumbler pair of any desired type. Moreover, the lock can accommodate a reversible key, as described.

It will be understood that the above description of the present invention is susceptible to various modifications, changes and adaptations, and the same are intended to be comprehended within the meaning and range of equivalents of the appended claims.

I claim:

1. In a cylinder lock, the combination which comprises:

a. a non-rotatable part having an axially extending chamber and recess means communicating with said chamber;

b. a plug arranged in said chamber of said non-rotatable part for rotation about an axis;

c. a reversible key axially insertable into said plug, from the same axial end thereof, while the key is in either of two angular positions;

d. a plurality of plate-shaped tumblers slidably mounted on said plug for movement transverse to said axis into and out of said recess means, said tumblers preventing rotation of said plug when at least one of said tumblers extends into said recess means, each of said tumblers having an opening through which said key, when inserted into said plug, may extend, said openings of said tumblers having respective contours which provide at least two contact edges which are next to each other and which are stepped in said transverse direction of movement of said tumblers, said tumblers being arranged in pairs, the tumblers of each pair being identical and located next to each other but oriented to occupy positions which are angularly displaced with respect to each other by 180° about said axis; and e. spring means associated with said tumblers for continually biasing the same for movement into said recess means, the spring means associated with the two tumblers of each pair urging said two tumblers in opposite directions;

f. said key having two parallel axially extending longitudinal edges each of which engages a contact edge of at least one of said tumblers for pressing the respective tumbler against the action of its associated spring means out of said recess means, said longitudinal edges of said key being arranged at least approximately opposite each other and each engaging one contact edge of a respective one of the two tumblers of each pair, each longitudinal edge of said key when the same is inserted in the lock, and the respective contact edge of the respective tumbler engaged thereby when such tumbler is out of said recess means, being spaced the same distance from said axis such that upon interengagement of said key and tumblers, the latter are maintained out of said recess means, the distance which each longitudinal edge of said key, at the point along its length where such edge is in axial alignment with a given tumbler but is out of engagement with any contact edge thereof, is spaced from said axis being the same as the distance which the non-engaged contact edge of such tumbler is spaced from said axis, the distance which each longitudinal edge of said key is spaced from said axis being constant throughout that portion of the length of the key which, when the key is inserted in the lock, is aligned with a pair of tumblers, said longitudinal edges of said key being non-symmetrical with respect to said axis such that upon reversal of said key, that longitudinal edge of said key which, prior to reversal, did not engage one of the tumblers of a given pair of tumblers is opposite and in contact with the contact edge of such tumbler which, prior to such reversal, was not contacted.

2. The combination defined in claim 1 wherein the two tumblers of each pair are arranged next to each other in axial direction, and wherein the contours of said tumbler openings are closed.

3. The combination defined in claim 1 wherein the two tumblers of each pair are arranged next to each other in a direction transverse to said axis, and wherein the contours of said tumbler openings are open with the openings of the contours of the two tumblers of each pair being directed toward each other, the opposite stepped contact edges of the two tumblers of each pair being laterally offset with respect to the direction of said transverse movement of said tumblers.

4. The combination defined in claim 1 wherein said longitudinal edges of said key are provided with axially extending portions which are connected by beveled portions, the latter, when said key is in the lock, being in axial alignment with a portion of at least some of said contact edges of said tumblers, the last-mentioned contact edges being likewise beveled to match the configuration of said beveled portions of said key.

* * * * *